US008342740B2

(12) United States Patent
Beccia et al.

(10) Patent No.: US 8,342,740 B2
(45) Date of Patent: Jan. 1, 2013

(54) OSCILLATING WEIGHT FOR AN AUTOMATIC WINDING WATCH, INCLUDING A POWER RESERVE INDICATOR DEVICE INTEGRATED IN SAID OSCILLATING WEIGHT

(75) Inventors: Vincent Beccia, Pully (CH); Vincent Calabrese, Lausanne (CH); Sébastien Graf, Le Mont-sur-Lausanne (CH)

(73) Assignee: Blancpain S.A., Le Brassus (CH)

( * ) Notice: Subject to any disclaimer, the term of this patent is extended or adjusted under 35 U.S.C. 154(b) by 134 days.

(21) Appl. No.: 13/028,850

(22) Filed: Feb. 16, 2011

(65) Prior Publication Data

US 2011/0205857 A1 Aug. 25, 2011

(30) Foreign Application Priority Data

Feb. 24, 2010 (EP) ..... 10154487

(51) Int. Cl.
*G04B 5/02* (2006.01)

(52) U.S. Cl. ..... 368/208; 368/212

(58) Field of Classification Search ..... 368/208, 368/210, 212
See application file for complete search history.

(56) References Cited

U.S. PATENT DOCUMENTS

| | | | | | |
|---|---|---|---|---|---|
| 663,263 | A * | 12/1900 | Elenius | 368/210 |
| 1,173,466 | A * | 2/1916 | Teske | 368/212 |
| 1,973,898 | A * | 9/1934 | Henry | 368/148 |
| 5,828,628 | A * | 10/1998 | Born et al. | 368/66 |
| 7,170,825 | B2 * | 1/2007 | Takahashi | 368/66 |
| 7,857,502 | B2 * | 12/2010 | Rochat | 368/212 |
| 2009/0129211 | A1 | 5/2009 | Rochat | |

FOREIGN PATENT DOCUMENTS

| | | | |
|---|---|---|---|
| CH | 301 497 | A | 9/1954 |
| EP | 0 851 320 | A1 | 7/1998 |
| EP | 1 826 633 | A1 | 8/2007 |

OTHER PUBLICATIONS

European Search Report for EP 10 15 448.2, dated Jul. 27, 2010.

* cited by examiner

*Primary Examiner* — Sean Kayes
(74) *Attorney, Agent, or Firm* — Sughrue Mion, PLLC

(57) ABSTRACT

The invention concerns an oscillating weight (1) for an automatic winding watch, including a power reserve indicator device (100) integrated in said oscillating weight (1) and including means (20) for displaying the power reserve by comparison to complementary display means (30), said display means (20) and complementary display means (30) being integrated in said oscillating weight (1).
Said display means (20) and complementary display means (30) are movably mounted to rotate synchronously, at a given moment, relative to said oscillating weight (1).
The invention also concerns an automatic winding watch including an oscillating weight (1) of this type, whose movements are transmitted to a mainspring of said watch.

11 Claims, 2 Drawing Sheets

OSCILLATING WEIGHT FOR AN AUTOMATIC WINDING WATCH, INCLUDING A POWER RESERVE INDICATOR DEVICE INTEGRATED IN SAID OSCILLATING WEIGHT

This application claims priority from European Patent Application No. 10154487.2 filed Feb. 24, 2010, the entire disclosure of which is incorporated herein by reference.

FIELD OF THE INVENTION

The present invention concerns an oscillating weight for an automatic winding watch, including a power reserve indicator device arranged to be integrated in said oscillating weight for an automatic winding movement, said device including means displaying the power reserve by comparison to complementary display means, said display means and said complementary display means being integrated in said oscillating weight.

The invention also concerns an automatic winding watch including an oscillating weight whose movements are transmitted to a mainspring of said watch, said oscillating weight including a power reserve indicator device of this type.

The invention concerns the field of automatic winding watches.

STATE OF THE PRIOR ART

In an automatic winding watch, the wearer's movements are transmitted to the mainspring via an oscillating weight and a reduction gear.

The gear train of an automatic winding mechanism is formed of toothed elements which allow the force to be transmitted from the oscillating weight to the ratchet and the mainspring to be wound. Upstream of the ratchet, this automatic winding mechanism train usually includes, on the one hand, an intermediate train formed of the oscillating weight pinion and intermediate direction reverser wheel sets, and on the other hand, a reduction gear, arranged for reducing the initial velocity of the oscillating weight and increasing the force used for winding the mainspring.

A useful and appreciated complication in automatic winding watches is the power reserve display, which is provided by a power reserve indicator device, enabling the user to see, at any time, the potential energy of the mainspring for normal work, in the best conditions of reliability and precision. In a known manner, the power reserve is indicated either by a graduated, numbered or graphic indication on a disc visible through an aperture, or by positioning a hand opposite a dial carrying such an indication.

The power reserve indication must be compatible with the small space remaining in a timepiece that includes several complications. It must be of exemplary reliability, in particular to dissuade the user from performing additional manual winding when the mainspring is already completely wound.

Automatic winding watches undergo high operating stress, since it is estimated that an automatic winding mechanism is subject to several million movements each year.

The restricted available space in a watch means that it is sought to use the volume of the oscillating weight itself for housing some functions, notably the power reserve indicator. However the aforecited operating stress has generally deterred designers from using the oscillating weight in this way.

CH Patent No. 301 497 discloses an automatic winding watch including an oscillating weight whose movements are transmitted to a mainspring of the watch, said watch also including a power reserve indicator device including power reserve display means.

There is also known from EP Patent No. 1 826 633, an automatic winding watch including an oscillating weight whose movements are transmitted to a mainspring of the watch, said watch also including a power reserve indicator device including power reserve display means, which is mounted on the oscillating weight.

SUMMARY OF THE INVENTION

The invention proposes to provide a solution to the problem of making a power reserve display device integrated in the oscillating weight, which is reliable, simple to implement and highly robust.

The present invention therefore concerns an oscillating weight for an automatic winding watch, including a power reserve indicator device arranged to be integrated in said oscillating weight for an automatic winding movement, said device including means for displaying the power reserve by comparison with complementary display means, said display means and said complementary display means being integrated in said oscillating weight, characterized in that said display means and said complementary display means are movably mounted to rotate synchronously, at a given time, relative to said oscillating weight.

According to one feature of the invention, said display means and complementary display means are rotatably mounted relative to a common axis of rotation.

According to another feature of the invention, said device includes a friction differential display mechanism with two inputs, one stationary and the other movable, and with one output formed by a display member including said display means and complementary display means, said movable input driving said display means, and said stationary input driving said complementary display means via disconnectable drive means.

According to another feature of the invention, said complementary display means includes a stop member, on which said display means is arranged for cooperating in abutment in a position called the end of winding position, and in that said stationary input cooperates with a disconnectable coupling, which is coupled with said complementary display means when said display means is not abutting on said stop member, and which is disconnected from said complementary display means when said display means is abutting on said stop member.

According to another feature of the invention, said end of winding position corresponds to the end of winding of a mainspring to which said movable input is connected via a gear train.

The invention also concerns an automatic winding watch including an oscillating weight whose movements are transmitted to a mainspring of said watch, said oscillating weight including a power reserve indicator device of this type.

Thus, this invention provides an automatic timepiece including a power reserve indicator device whose power reserve display mechanism is carried by the oscillating weight. The simplicity and compactness of the invention make it particularly advantageous to use. Excellent reliability is ensured and operation is guaranteed regardless of the level of wind of the mainspring. The display of information relating to the power reserve is particularly legible, whatever the position of the oscillating weight.

DESCRIPTION OF THE DRAWINGS

Other features and advantages of the present invention will appear more clearly from the following detailed description of one embodiment of the watch according to the invention, this example being given solely by way of non-limiting illustration with reference to the annexed drawings 1 to 3, in which.

DETAILED DESCRIPTION OF THE INVENTION

Figure 1:
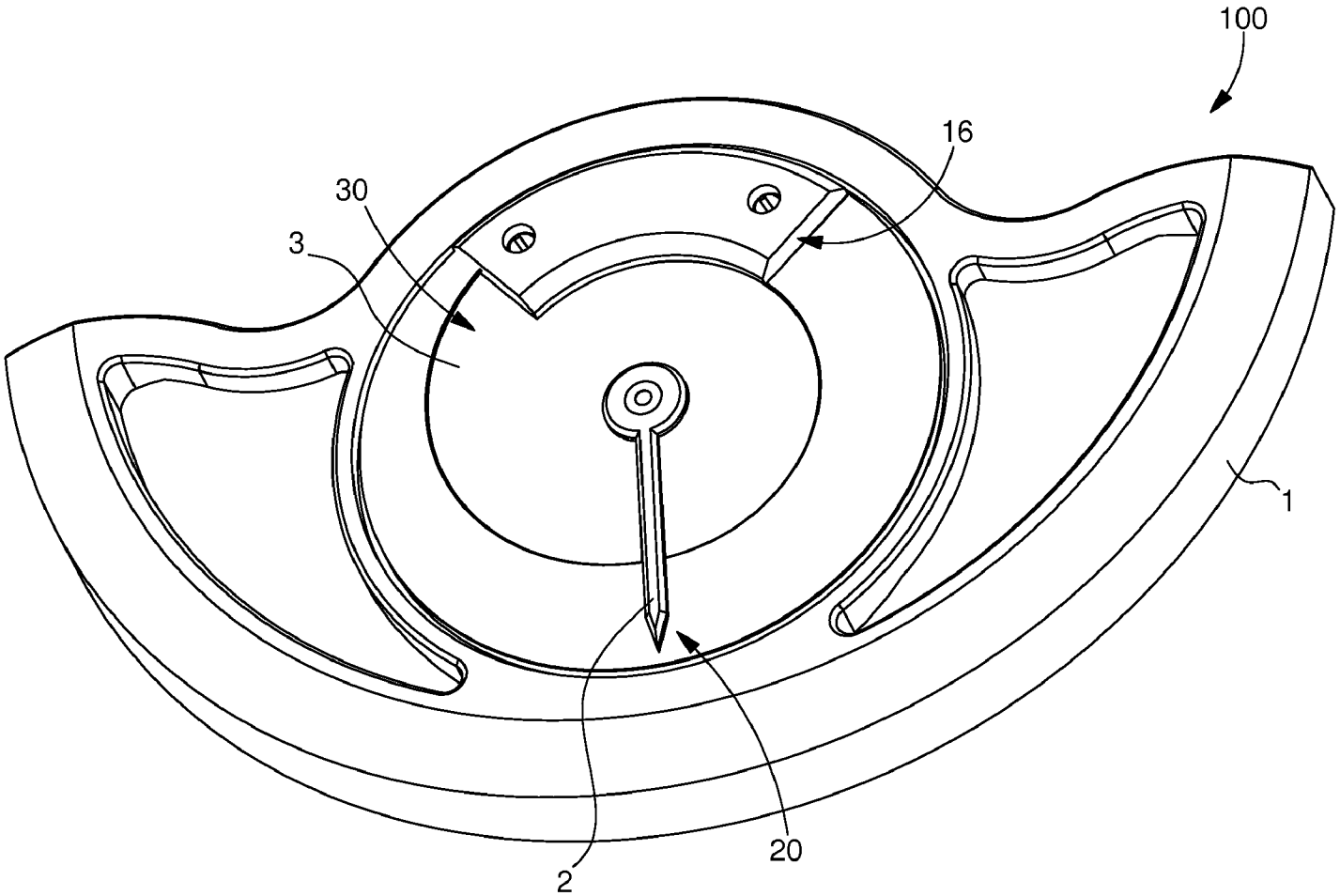
FIG. 1 is a schematic perspective top diagram of an oscillating weight including a power reserve indicator device according to the invention, in a preferred embodiment.

The invention concerns the field of automatic winding watches with an oscillating weight. The invention proposes to provide a solution to the problem of making a power reserve display mechanism integrated in the oscillating weight, which is reliable, simple to implement and robust.

An oscillating weight 1 oscillates in a pivoting movement about a pivotal axis D1, generally, but not necessarily, located at the centre of the watch movement in which the oscillating weight is placed. This watch includes, in a conventional manner, a mainspring to which the movements of oscillating weight 1 are transmitted in order to wind said spring. The invention applies to an oscillating weight 1 which may be located either below or above the watch movement, which is not shown in the Figures for the sake of simplification.

The invention concerns an oscillating weight for an automatic winding watch, including a power reserve indicator device 100 arranged to be integrated in said oscillating weight 1 for an automatic winding movement.

This device 100 includes means 20 for displaying the power reserve by comparison to complementary display means 30, for example respectively a hand 2 and a dial 3. This display means 20 and complementary display means 30 are integrated in oscillating weight 1.

According to the invention, both display means 20 and complementary display means 30 are rotatably mounted relative to oscillating weight 1. This rotation is synchronous at a given time, i.e. display means 20 occupies a particular instantaneous position relative to complementary display means 30 according to the remaining potential energy of the mainspring at the moment concerned, but this relative angular position of one with respect to the other is not dependent upon the movements imparted by the user to the oscillating weight, since, according to the invention, apart from the angular shift of the power reserve display, display means 20 and complementary display means 30 rotate synchronously relative to oscillating weight 1, In a preferred embodiment, seen in the Figures, display means 20 and complementary display means 30 are rotatably mounted relative to a common axis of rotation D2.

This invention is illustrated with power reserve indicator display means 20 formed of a hand 2, which cooperates with complementary display means 30 formed of a dial 3. It goes without saying that this example is given purely by way of non-limiting illustration, and that the invention can apply in a similar manner to a power reserve indication using the cooperation of several dials, or several hands, or other elements.

In an innovative manner, device 100 according to the invention includes a friction differential display mechanism with two inputs, one stationary and the other movable, and one output:

- the stationary input drives complementary display means 30 via disconnectable drive means;
- the movable input drives display means 20 via non-disconnectable drive means;
- the output is formed by a display member including display means 20 and complementary display means 30.

Figure 2:
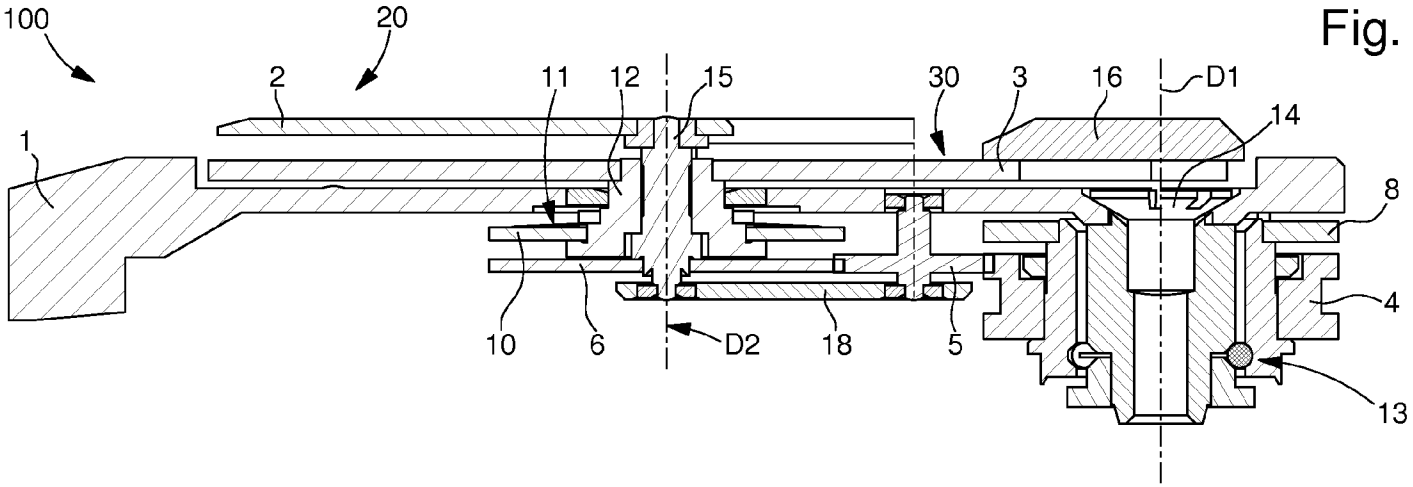
FIG. 2 is a cross-section of the device of FIG. 1, along a cross-sectional plane showing operation during winding or letting down, and the kinematics between a movable input on the one hand, and display means on the other hand, of said device.
Figure 3:
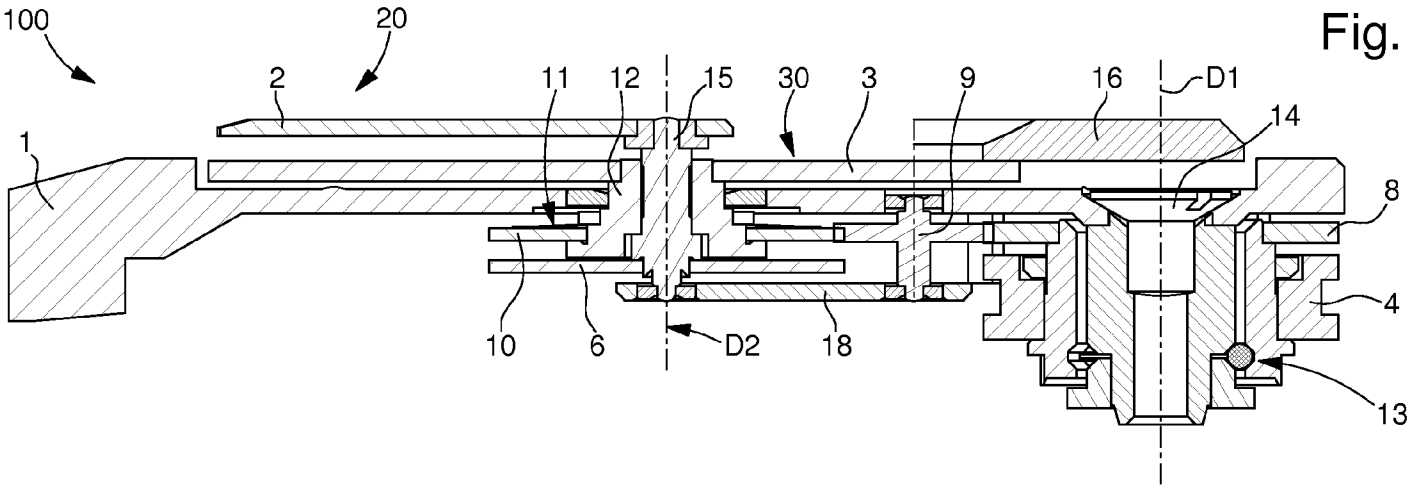
FIG. 3 is a cross-section of the device of FIG. 1 along a cross-sectional plane showing the cancellation of the rotational effect of the oscillating weight, and the kinematics between a stationary input on the one hand, and complementary display means on the other hand, of said device.

As seen in FIGS. 2 and 3, the display differential mechanism includes a ball bearing 13, whose inner frame carries oscillating weight 1 via a screw 14 and whose outer frame, on the one hand carries a stationary wheel 8 forming said stationary input, and on the other hand serves as a rotational support for a movable wheel 4 forming said movable input.

Complementary display means 30 includes a stop member 16. Display means 20 is arranged for cooperating in abutment on said stop member 16 in an end of winding position. This end of winding position corresponds to the end of winding of the mainspring, to which the movable input is connected via a gear train. The stationary input cooperates with a disconnectable coupling, which is connected to complementary display means 30 when display means 20 is not abutting on stop member 16, and which is disconnected from complementary display means 30 when display means 20 is abutting on said stop member 16. As seen in FIG. 3, dial 3 includes a stop member 16 of this type, integral with dial 3. In a preferred, but in no way limiting, embodiment, seen in FIGS. 2 and 3, this disconnectable coupling includes a friction wheel 10. This friction wheel is secured to complementary display means 30 via the action of elastic return means when display means 20 is not abutting on stop member 16, and is disconnected from complementary display means 30 when display means 20 is abutting on said stop member. The stationary input, notably stationary wheel 8, cooperates with friction wheel 10, which is arranged to be secured to dial 3, via the action of a metal foil 11 forming said elastic return means, when hand 2 is not abutting on stop member 16, and to be disconnected from dial 3, when hand 2 is abutting on stop member 16. Consequently, when hand 2 reaches a stop against the completely wound it has a tendency to push dial 3. Metal foil 11 allows friction wheel 10 to be driven in normal operation, i.e. during winding or letting down, and disconnection at the end of winding. It is clear that the friction enables the system to be disconnected, which prevents any damage thereto.

Indeed, referring to the particular case illustrated in the Figures with a hand 2 cooperating with a dial 3, during the pivoting rotation of oscillating weight 1, dial 3 and hand 2 rotate in the opposite direction to oscillating weight 1. By design, as will be explained below, the ratio between the various gear trains is 1, consequently dial 3 and hand 2 rotate in the opposite direction to oscillating weight 1, but at the same velocity, in synchronous rotation at a given instant, giving the user the impression that dial 3 and hand 2 are not rotating when oscillating weight 1 is rotating. Naturally, hand 2 has relative mobility with respect to dial 3, according to the potential energy of the mainspring. During normal operation, when the mainspring is being wound or let down, the result reaches movable wheel 4 which forms the movable input, and allows an angular shift by hand 2 with respect to dial 3, thus displaying the potential energy reserve.

Conversely, at the end of winding of the mainspring, hand 2 abuts on stop member 16 of dial 3, which forces the latter to rub on friction wheel 10 and to shift at the same velocity as hand 2.

In order to obtain a ratio of 1 between the gear trains in a simple manner and guarantee synchronisation between hand 2 and dial 3, movable wheel 4 and stationary wheel 8 are advantageously chosen to have the same number of teeth.

Movable wheel 4 drives, via an intermediate wheel 5, an indicator wheel 6 which is secured, preferably via an indicator arbour 15, to display means 20, notably hand 2.

Stationary wheel 8 drives, via an intermediate wheel 9, friction wheel 10, which is freely rotatably mounted on an arbour 12 secured to complementary display means 30, notably dial 3.

Preferably, friction wheel 10 and indicator wheel 6 have the same number of teeth as movable wheel 4 and stationary wheel 8, and intermediate wheels 5 and 9 which form the connection between the display and the centre of the movement, are identical to each other.

A plate 18 secured to oscillating weight 1 includes reversal bearings for intermediate wheels 5 and 9, and indicator arbour 5.

The invention also concerns an automatic winding watch including an oscillating weight 1 whose movements are transmitted to a mainspring comprised in said watch, said oscillating weight 1 including a power reserve indicator device 100.

It goes without saying that this invention is not limited to the embodiment that has just been described and that various simple alterations and variants can be envisaged by those skilled in the art without departing from the scope of the invention as defined by the annexed claims. In particular, it is possible to envisage inserting intermediate wheels so that the gear ratios are equal and of opposite signs, and the ratio between the various gears of the differential display mechanism are kept at 1.

What is claimed is:

1. An oscillating weight for an automatic winding watch, including a power reserve indicator device arranged to be integrated in said oscillating weight for an automatic movement, said device including means for displaying the power reserve by comparison to complementary display means, said display means and complementary display means being integrated in said oscillating weight, wherein said display means and complementary display means are arranged to be movably mounted to rotate synchronously, at a given moment, relative to said oscillating weight.

2. The oscillating weight according to claim 1, wherein it includes a friction differential display mechanism with two inputs, one stationary and the other movable, and one output formed by a display member including said display means and complementary display means, said movable input driving said display means, and said stationary output driving said complementary display means via disconnectable drive means.

3. The oscillating weight according to claim 2, wherein said complementary display means includes a stop member, on which said display means is arranged for cooperating by abutment in a position called the end of winding position, and wherein said stationary input cooperates with a disconnectable coupling, which is arranged to be connected to said complementary display means when said display means is not abutting on said stop member and which is arranged to be disconnected from said complementary display means when said display means is abutting on said stop member.

4. The oscillating weight according to claim 3, wherein said disconnectable coupling includes a friction wheel, which is arranged to be secured to said complementary display means under the action of a metal foil when said display means is not abutting on said stop member, and to be disconnected from said complementary display means, when said display means is abutting on said stop member.

5. The oscillating weight according to claim 3, wherein said end of winding position corresponds to the end of winding of a mainspring to which said movable input is connected via a gear train.

6. The oscillating weight according to claim 3, wherein said stop member is integral with said complementary display means.

7. The oscillating weight according to claim 2, wherein said differential display mechanism includes a ball bearing whose inner frame carries said oscillating weight and whose external frame, on the one hand carries a stationary wheel forming said stationary input, and on the other hand serves as a rotational support for a movable wheel forming said movable input.

8. The oscillating weight according to claim 4, wherein said differential display mechanism includes a ball bearing whose inner frame carries said oscillating weight and whose external frame, on the one hand carries a stationary wheel forming said stationary input, and on the other hand serves as a rotational support for a movable wheel forming said movable input and in that said movable wheel and said stationary wheel have the same number of teeth, and that said movable wheel drives, via an intermediate wheel, an indicator wheel integral with said display means, and that said stationary wheel drives, via an intermediate wheel, said friction wheel, which is freely rotatably mounted on an arbour integral with said complementary display means, said friction wheel and said indicator wheel having the same number of teeth as said movable wheel and said stationary wheel.

9. The oscillating weight according to claim 1, wherein said display means and complementary display means are rotatably mounted relative to a common axis of rotation.

10. The oscillating weight according to claim 1, wherein said display means is formed by a hand and wherein said complementary display means is formed by a dial.

11. An automatic winding watch including an oscillating weight whose movements are transmitted to a mainspring comprised in said watch, said oscillating weight including a power reserve indicator device according to claim 1.

* * * * *